US009413104B2

(12) United States Patent
Liao

(10) Patent No.: US 9,413,104 B2
(45) Date of Patent: Aug. 9, 2016

(54) MAGNETIC LIGHT SOURCE ADAPTOR AND LIGHT SOURCE THEREFOR

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 0 days.

(21) Appl. No.: 14/950,003

(22) Filed: Nov. 24, 2015

(65) Prior Publication Data

US 2016/0079701 A1 Mar. 17, 2016

Related U.S. Application Data

(63) Continuation-in-part of application No. 13/751,212, filed on Jan. 28, 2013, now abandoned.

(51) Int. Cl.

| | |
|---|---|
| ***F21V 21/00*** | (2006.01) |
| ***H01R 13/62*** | (2006.01) |
| ***F21V 23/06*** | (2006.01) |
| ***H01R 33/94*** | (2006.01) |
| *F21Y 101/02* | (2006.01) |
| *H01R 33/22* | (2006.01) |
| *H01R 33/92* | (2006.01) |

(52) U.S. Cl.

CPC ..... *H01R 13/6205* (2013.01); *F21V 23/06* (2013.01); *H01R 33/94* (2013.01); *F21Y 2101/02* (2013.01); *H01R 33/22* (2013.01); *H01R 33/92* (2013.01)

(58) Field of Classification Search

CPC .... H01R 13/6205; H01R 33/22; H01R 33/92; H01R 33/94; F21V 23/00; F21Y 2101/02

USPC ..... 362/398, 640, 647

See application file for complete search history.

(56) References Cited

U.S. PATENT DOCUMENTS

| | | | | | |
|---|---|---|---|---|---|
| 2,788,501 | A * | 4/1957 | Buquor | H01J 5/56 | 439/39 |
| 3,070,767 | A * | 12/1962 | Rabinow | H01R 33/94 | 338/70 |
| 6,380,683 | B1 * | 4/2002 | Kahn | H01J 5/50 | 315/56 |
| 6,986,590 | B1 * | 1/2006 | Padden | A44B 15/005 | 362/116 |
| 7,407,302 | B2 * | 8/2008 | Allard | A23G 3/50 | 362/109 |
| 8,328,582 | B1 * | 12/2012 | Carley | H01R 33/94 | 439/642 |
| 2002/0180367 | A1 * | 12/2002 | Logan | H05B 37/0209 | 315/119 |
| 2004/0052073 | A1 * | 3/2004 | Chang | F21L 4/04 | 362/197 |
| 2004/0080933 | A1 * | 4/2004 | Cheetham | F21L 4/027 | 362/205 |
| 2008/0085111 | A1 * | 4/2008 | Fowler | A61B 1/00105 | 396/199 |
| 2008/0273348 | A1 * | 11/2008 | Klohn | A41G 1/005 | 362/567 |
| 2009/0045715 | A1 * | 2/2009 | Shantha | F21K 9/135 | 313/51 |
| 2010/0068899 | A1 * | 3/2010 | Shvili | F21V 19/006 | 439/39 |
| 2012/0071008 | A1 * | 3/2012 | Sessford | H01R 13/6205 | 439/39 |

* cited by examiner

*Primary Examiner* — Ali Alavi

(74) *Attorney, Agent, or Firm* — Li & Cai Intellectual Property (USA) Office

(57) ABSTRACT

A magnetic light source adaptor includes a main body, a control module and a magnetic unit. The main body has a male portion and a female portion. A first conducting set is disposed within the female portion, whereas a second conducting set is arranged on the male portion. The control module is arranged on the main body and electrically connecting the first and second conducting sets. The magnetic unit attaches to the main body to facilitate positioning of the magnetic light source adaptor. The magnetic light source adaptor and a light source are detachably assembled for easier access under maintenance and replacement.

26 Claims, 20 Drawing Sheets

MAGNETIC LIGHT SOURCE ADAPTOR AND LIGHT SOURCE THEREFOR

CROSS-REFERENCE TO RELATED APPLICATIONS

This Application is a Continuation-in-Part of application Ser. No. 13/751,212 filed Jan. 28, 2013, now pending, and entitled Magnetic Light Source Adaptor and Light Source therefor.

BACKGROUND OF THE INVENTION

1. Field of the Invention

The present invention relates to a magnetic light source adaptor and a light source; in particular, to a magnetic light source adaptor which is disposed between a lamp socket and a light source, can be independently replaced, meets modern environmental standards, and is easy to install and disassemble.

2. Description of Related Art

Light source (such as light bulbs, light tubes) is an indispensable household article and common in many public facilities. To meet the requirements of different settings, current light sources have a wide variety of functions. An appropriate control module is typically installed inside or outside the light source so that the light source can have energy saving, automatic sensing, light switching, remotely controlling and other capabilities.

However conventional light sources and their control modules have definite life spans. If the control module is disposed inside the light source, the entire combination has to be replaced whether the light source or the control module is damaged, resulting in waste and not meeting the modern environmental standards. Even though the control module can be fixed outside the light source such that the light source and the control module can be independently replaced when damaged, disassembly is still very inconvenient due to the fact that the control module is fixed to high positions such as the ceiling, is fixedly connected to the circuit, and hidden inside the ceiling.

SUMMARY OF THE INVENTION

The object of the present invention is to provide a magnetic light source adaptor and a light source. The magnetic light source adaptor and the light source are designed as an assembly, able to be replaced independently to reduce waste and meet modern environmental standards. The assembly and disassembly of the magnetic light source adaptor is also very convenient.

In order to achieve the aforementioned objects, the present disclosure provides an magnetic light source adaptor, which includes: a main body, which has a female portion and a male portion, wherein an accommodating space is formed within the female portion, a first conducting set is disposed within the female portion, and a second conducting set is disposed on the male portion; a control module disposed on the main body and electrically connected to the first and second conducting sets; and a magnetic unit disposed on the main body.

The present disclosure further provides a light source having a first contact point and a second contact point. A magnet is disposed on the light source.

The present disclosure has the following advantages: the magnetic light source adaptor can be designed as an assembly with the light source, and fixed by magnets. When the magnetic light source adaptor or the light source is damaged, each of the two can be independently replaced, preventing waste and meeting modern environmental standards. The magnetic light source adaptor and the lamp socket are installed in a removable manner and exposed outside, thus are easy to install and disassemble.

The magnetic light source adaptor of the present disclosure can further include a signal device for signaling damaged parts. When the control module, the light source or the power supply is damaged, the signaling device can emit light or sound to achieve the function of signaling damaged parts, facilitating the repairing and replacing of damaged parts.

In order to further the understanding regarding the present invention, the following embodiments are provided along with illustrations to facilitate the disclosure of the present invention but do not define the invention.

DETAILED DESCRIPTION OF THE PREFERRED EMBODIMENTS

The aforementioned illustrations and following detailed descriptions are exemplary for the purpose of further explaining the scope of the present invention. Other objectives and advantages related to the present invention will be illustrated in the subsequent descriptions and appended drawings.

First Embodiment

Figure 1:
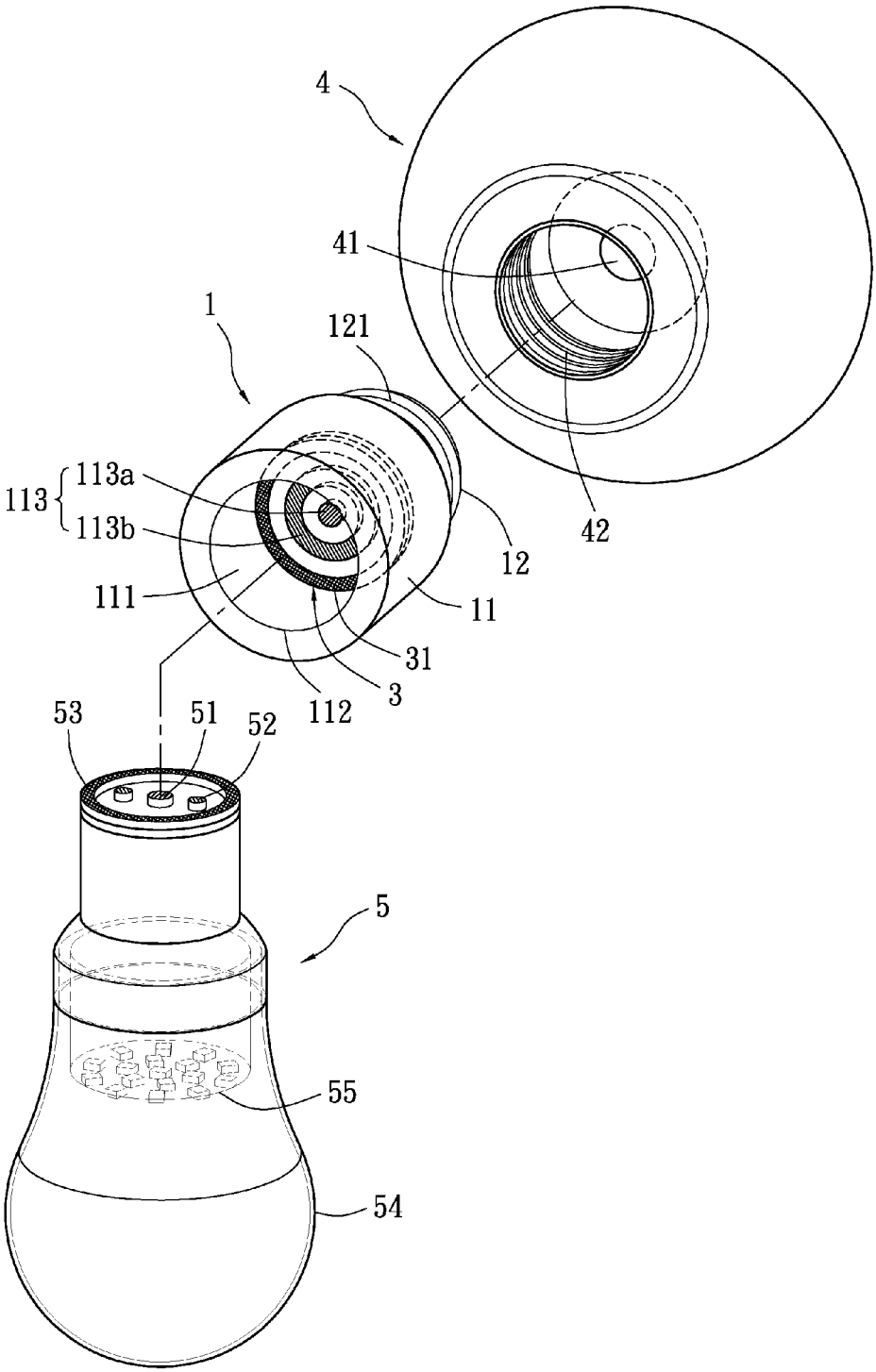
FIG. 1 shows a perspective schematic diagram of a first embodiment of the present disclosure.
Figure 2:
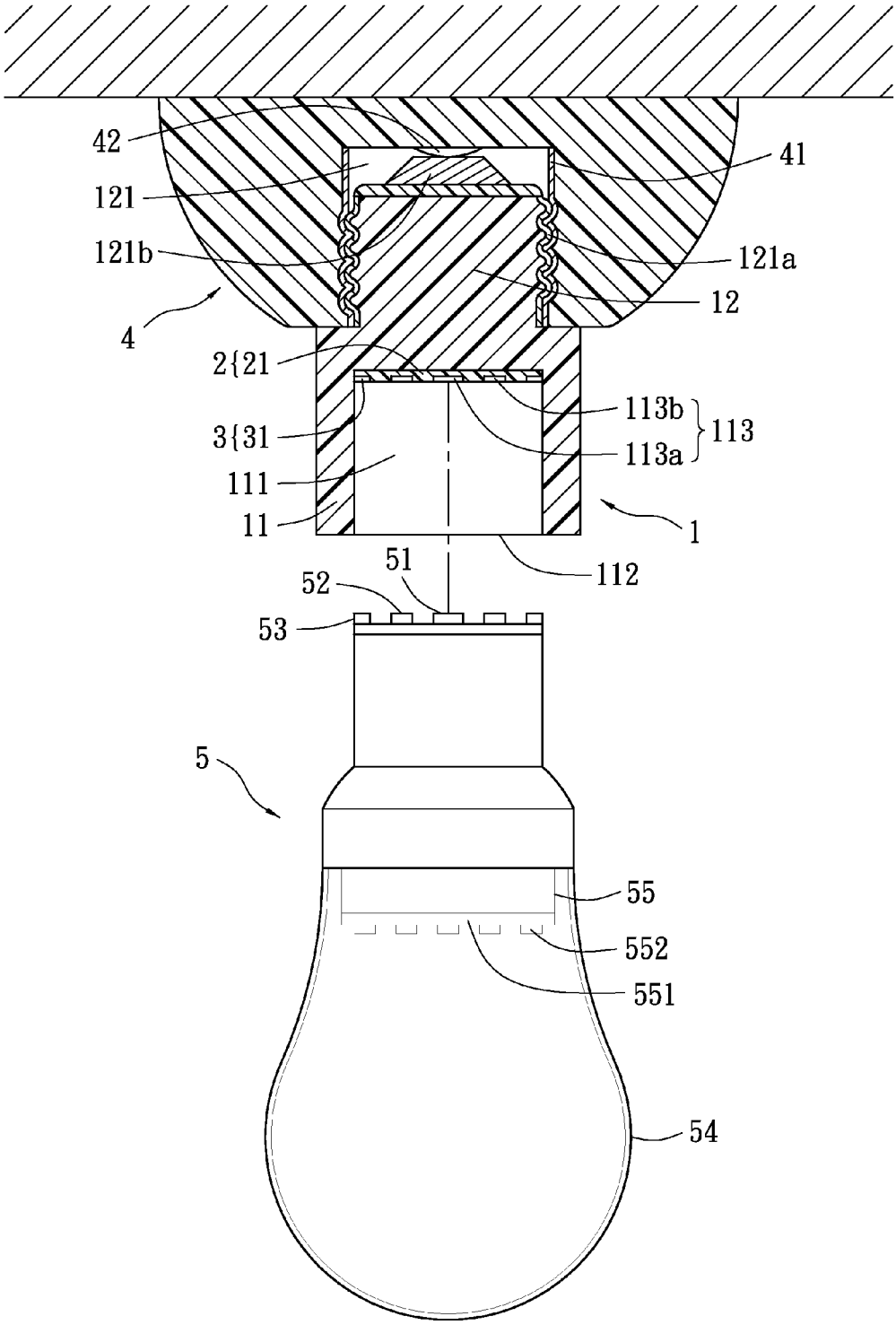
FIG. 2 shows a cross sectional schematic diagram of a first embodiment of the present disclosure.

FIG. 1 and FIG. 2 show a first embodiment of the magnetic light source adaptor of the present disclosure. The present embodiment is applicable on a light source of the light-bulb type. The magnetic light source adaptor includes a main body 1, a control module 2 and a magnetic unit 3. The main body 1 has a female portion 11 and a male portion 12. The female portion 11 is made of material such as plastic. An accommodating space 111 corresponding to the structural shape of a light source 5 to be installed is formed in the female portion 11. The bottom part of the accommodating space 111 can have an opening 112. A first conducting set 113 is disposed within the female portion 11. The first conducting set 113 can be plug type or screw type. The first conducting set 113 of the present embodiment is plug type. The first conducting set 113 includes a first conducting member 113*a* and a second conducting member 113*b* made of metal with good conductivity. The first conducting member 113*a* and the second conducting member 113*b* are fixed at the top part of the accommodating space 111 and respectively act as the anode and cathode. The first conducting member 113*a* can be disposed on the center position of the top part of the accommodating space 111. The second conducting member 113*b* can be disposed around the first conducting member 113*a* in an annular shape. The female 11 portion of the present disclosure is designed correspondingly to the light source 5, and can be modified to meet different forms of the light source 5.

The male portion 12 is made of material such as plastic. The male portion 12 is integrated as one piece with or connected by assembly to the female portion 11. A second conducting set 121 is disposed on the male portion 12. The second conducting set 121 of the present disclosure includes a threaded sleeve 121*a* and a contact plate 121*b*. The threaded sleeve 121*a* and the contact plate 121*b* are both made of metal with good conductivity. The threaded sleeve 121*a* is fixed on the outer edge of the male portion 12 and is a threaded structure. The contact plate 121*b* is disposed on the top part of the male portion 12. The threaded sleeve 121*a* and the contact plate 121*b* respectively act as the anode and cathode contact points. In order to adapt to different forms of lamp sockets, the male portion 12 of the present embodiment can be modified appropriately.

The control module 2 is disposed on the main body 1. The control module 2 can be disposed inside the female portion 11, outside the female portion 11, or on an appropriate location on the main body 1. The structure and function of the control module 2 is not limited. The control module 2 has a circuit board 21. Electric circuit and chips can be disposed on the circuit board 21 (not shown in the figure), for providing energy saving, automatic sensing, light switching, remote control, wireless transmission and other functions. The control module 2 can be controlled by switch, remote control, sound or light sensing control. The control module 2 can be electrically connected to the first conducting member 113*a* and the second conducting member 113*b* of the first conducting set 113 and the threaded sleeve 121*a* and the contact plate 121*b* of the second conducting set by cables or other conducting component (not shown in the figure).

The magnetic unit 3 is disposed on the main body 1, for magnetically attracting and fixing the light source 5. The magnetic unit 3 can be fixed on the main body 1 or on the control module 2. The magnetic unit 3 can be positioned inside or outside the accommodating space 111, as long as it can provide the light source 5 a place to be fixed magnetically. The magnetic unit 3 of the present embodiment is fixed on the control module 2, namely on the circuit board 21 of the control module 2. The magnetic unit 3 can be a first magnet 31, whose shape and amount is not limited. The first magnet 31 can be of any shape. In the present embodiment the first magnet 31 has an annular shape and is disposed on the circuit board 21 of the control module 2.

The magnetic light source adaptor can apply the male portion 12 to be screwed into a typical lamp socket 4, such that the magnetic light source adaptor can be installed on the lamp socket 4 in a removable manner. The threaded sleeve 121*a* and the contact plate 121*b* of the male portion 12 are respectively in contact with contact points 41, 42 of the lamp socket 4 thus achieving electrical connection. Thereafter, the light source 5 can be connected to the female portion 11, such that the light source 5 is installed on the female portion 11 in a removable manner. The light source 5 of the present embodiment is an LED light, but is not limited thereto. The light source 5 has a first contact point 51 and a second contact point 52. The first contact point 51 can be positioned at the center of the top part of the light source 5. The second contact point 52 can be positioned around the first contact point 51. The first contact point 51 and the second contact point 52 can be respectively in contact with the first contacting member 113*a* and the second contacting member 113*b* of the female portion 11, thus achieving electrical connection such that the power supply provided by the lamp socket 4 can be transmitted to the light source 5 via the magnetic light source adaptor, thereby lighting the light source 5.

The light source 5 can have a lamp shade 54 and a lighting module 55 disposed inside the lamp shade 54. The lighting module 55 includes the circuit board 551 and multiple light-emitting diodes 552 disposed on the circuit board 551. The light emitting diodes 552 are electrically connected to the circuit board 551. The circuit board 551 is electrically connected to the first contact point 51 and the second contact point 52. The light emitted by the light emitting diodes 552 can shine through the lamp shade 54.

A second magnet 53 corresponding to the first magnet 31 can be disposed on the light source 5. The second magnet 53 can be annular shaped. The faces on the first magnet 31 and the second magnet 53 facing each other have opposite magnetic poles. The second magnet 53 can be a corresponding magnetic attracting unit, such that the first magnet and the second magnet can be attracted and fixed to each other. Additionally, a locking unit (not shown in the figure) can also be disposed on the main body 1 for fixing the light source 5.

The form of the magnetic unit 3 is not limited. For example, the first magnet 31 can also be replaced by a metal plate, such that the magnetic unit 3 (the metal plate) can be attracted and fixed to the second magnet 53. Moreover, the second magnet 53 on the light source 5 can also be replaced by a metal plate, such that the magnetic unit 3 (the first magnet 31) can be attracted and fixed to the metal plate on the light source 5. The second magnet 53 or metal plate can be viewed as a magnetically attracting unit.

Second Embodiment

Figure 3:
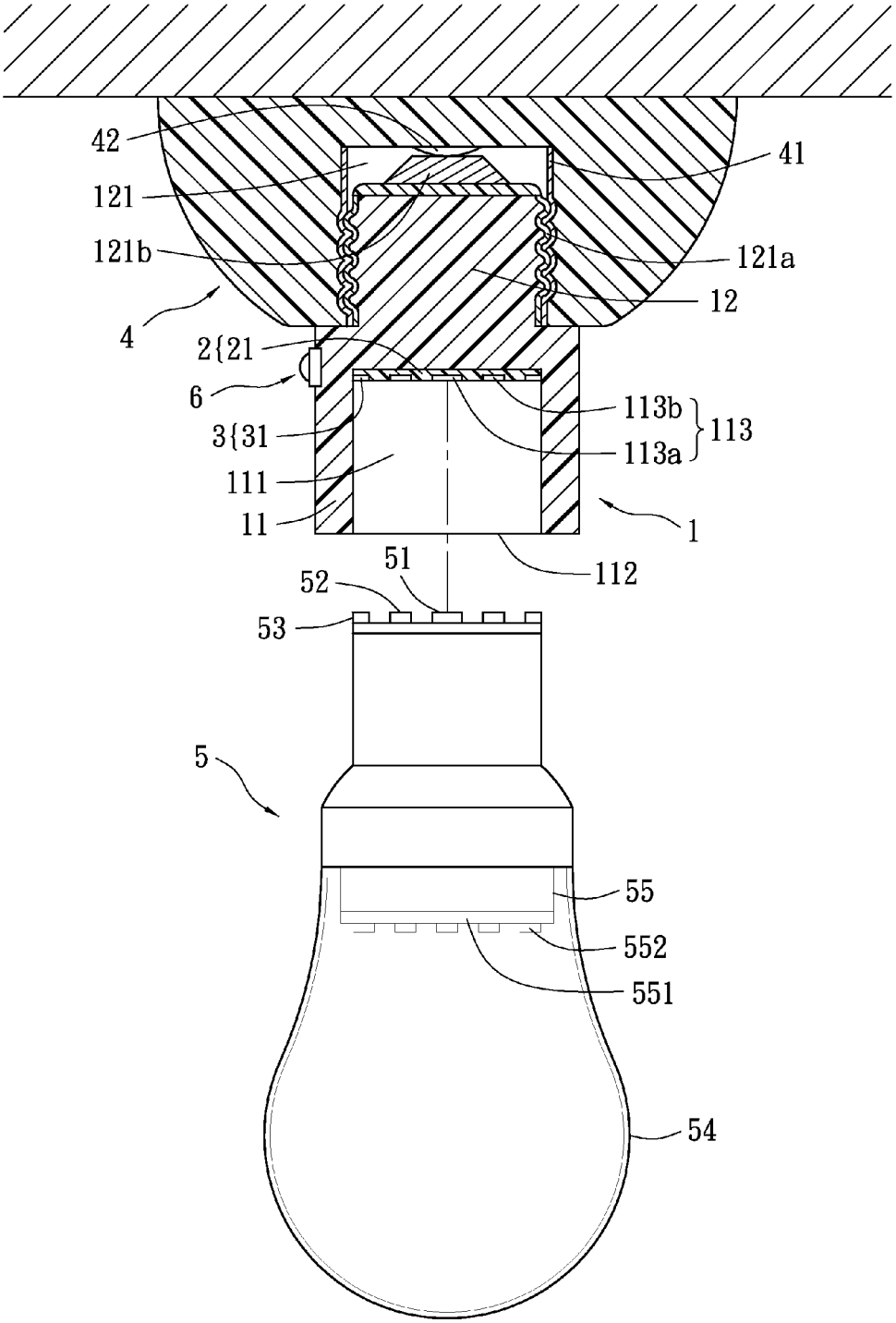
FIG. 3 shows a cross sectional schematic diagram of a second embodiment of the present disclosure.

Referring to FIG. 3, the second embodiment of the present disclosure discloses at least one signaling device 6 disposed on the main body 1 for signaling damage. The signaling device 6 can be a light-emitting diode (LED) or other light emitting unit, or a sound emitting unit such as a buzzer. The signaling device 6 is electrically connected to the control module 2. When the control module 2, the light source 5 or the power supply is damaged, the signaling device 6 can signal the damage by emitting light or sound.

Third Embodiment

Figure 4:
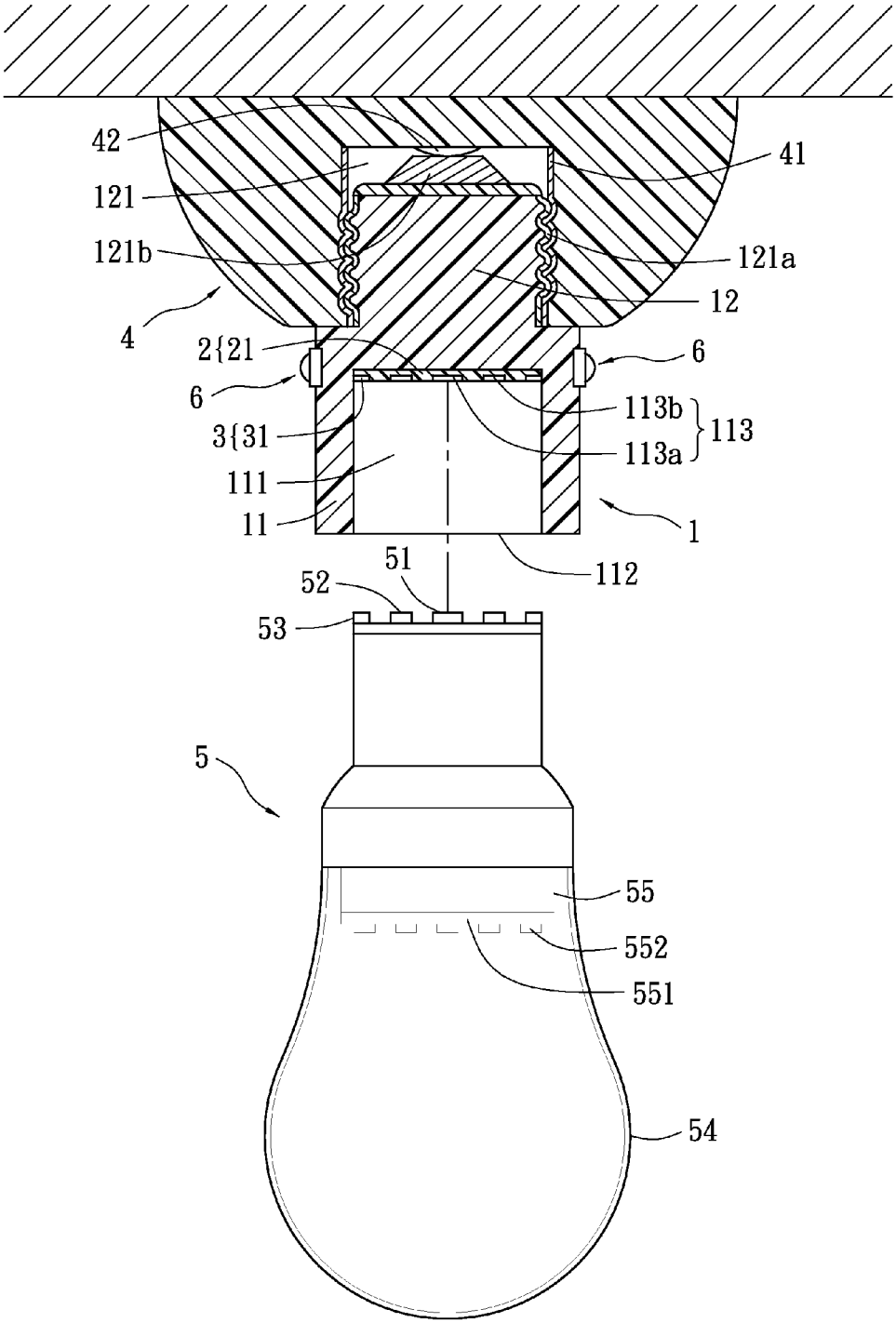
FIG. 4 shows a cross sectional schematic diagram of a third embodiment of the present disclosure.

Referring to FIG. 4, the third embodiment of the present disclosure discloses multiple signaling devices 6. The signaling devices 6 are light-emitting diodes (LED) or other light emitting units. The signaling devices 6 are electrically connected to the control module 2. The signaling devices 6 are disposed on the female portion 11 of the main body 1. The signaling devices 6 can be dotted or ringed around the outer edge of the female portion 11, in order to enhance the signaling effect.

Fourth Embodiment

Figure 5:
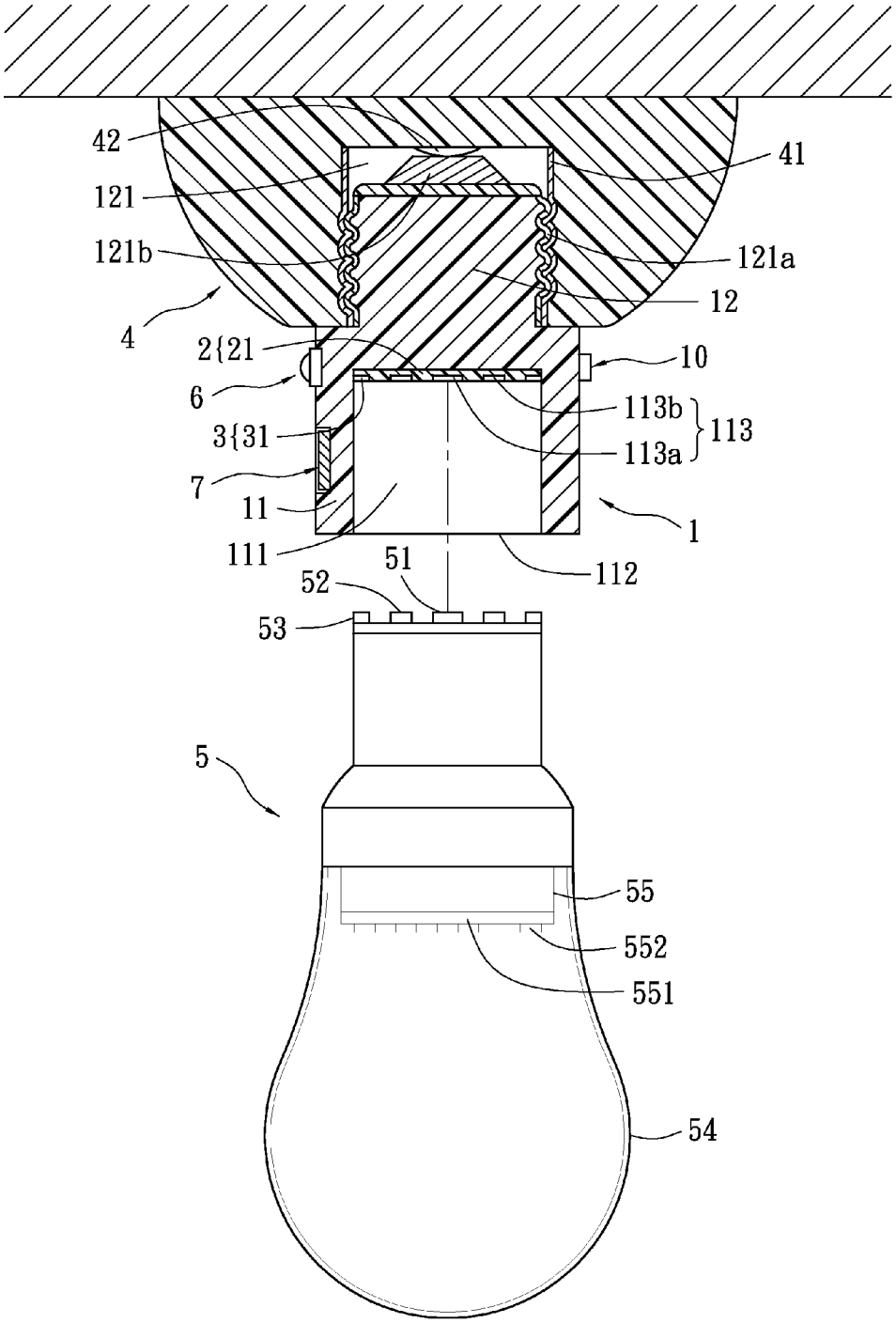
FIG. 5 shows a cross sectional schematic diagram of a fourth embodiment of the present disclosure.

Referring to FIG. 5, the fourth embodiment of the present disclosure discloses a removable battery 7 disposed on the main body 1 of the magnetic light source adaptor. The battery 7 is electrically connected to the control module 2. The battery 7 is a rechargeable battery. With this configuration, during power outages, the battery 7 can provide the light source 5 with electrical power to achieve the function of emergency lighting. A switch 10 can also be disposed on the main body 1. The switch 10 is electrically connected to the control module 2, for switching the function mode between emergency lighting and flashlight.

Fifth Embodiment

Figure 6:
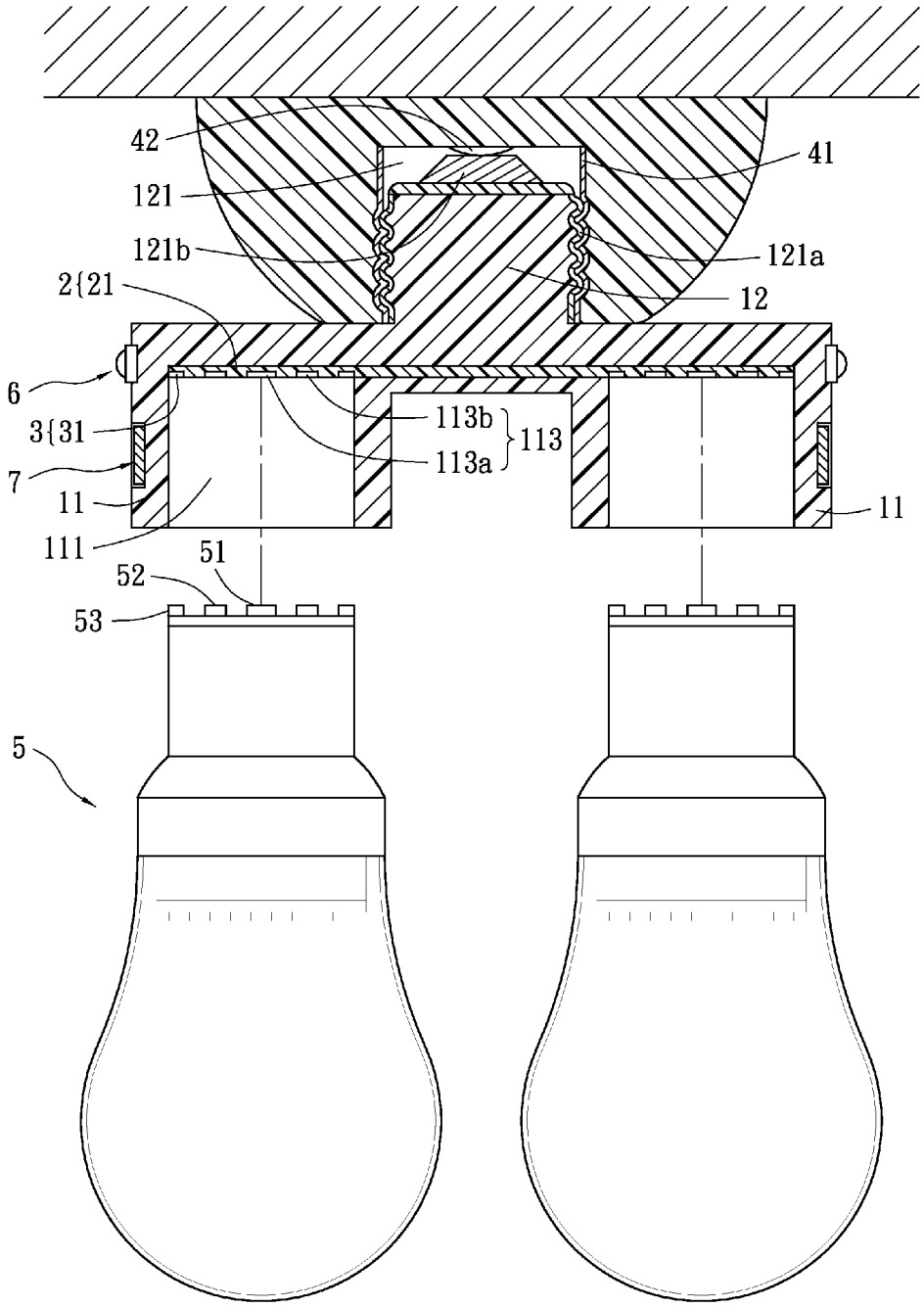
FIG. 6 shows a cross sectional schematic diagram of a fifth embodiment of the present disclosure.

Referring to FIG. 6, the fifth embodiment of the present disclosure discloses an magnetic light source adaptor with two female portions 11. The control module 2 is electrically connected to the first conducting set 113 of the female portions 11 and the second conducting set 121 of the male portion 12, such that the male portion 12 corresponds to two female portions 11 to facilitate the assembly of two light sources 5. Moreover, multiple female portions 11 can be disposed (not shown in the figure). The control module 2 is electrically connected to the first conducting sets 113 of the female portions 11 and the second conducting set 121 of the male portion 12, such that the male portion 12 corresponds to multiple female portions 11 to facilitate the assembly of multiple light sources 5.

Sixth Embodiment

Figure 7:
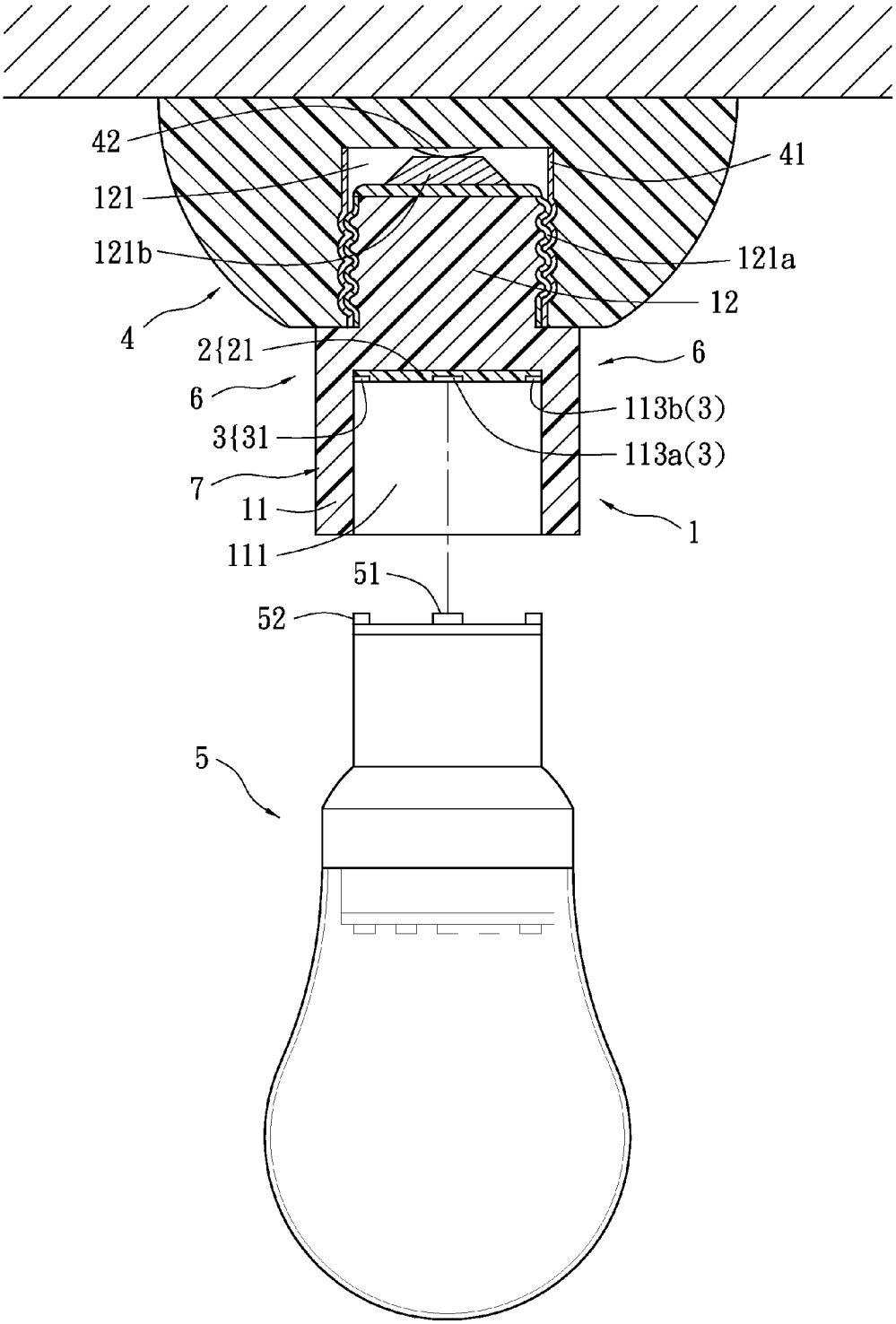
FIG. 7 shows a cross sectional schematic diagram of a sixth embodiment of the present disclosure.

Referring to FIG. 7, the sixth embodiment of the present disclosure discloses a first conducting set 113 of the magnetic light source adaptor made of magnet. Namely, the first conducting member 113*a* and the second conducting member 113*b* are magnets, with the first conducting set 113 as the magnetic unit 3, integrating the first conducting set 113 and the magnetic unit 3 into one body. Additionally, the first contact point 51 and the second contact point 52 of the light source 5 are also magnets, such that the first contact point 51 and the second contact point 52 can be electrically connected to the first conducting member 113*a* and the second conducting member 113*b*, and the first contact point (magnet) 51 and the second contact point (magnet) 52 are respectively attracted and fixed to the first conducting member (magnet) 113*a* and the second conducting member (magnet) 113*b* of the first conducting set 113.

Seventh and Eighth Embodiments

Figure 8:
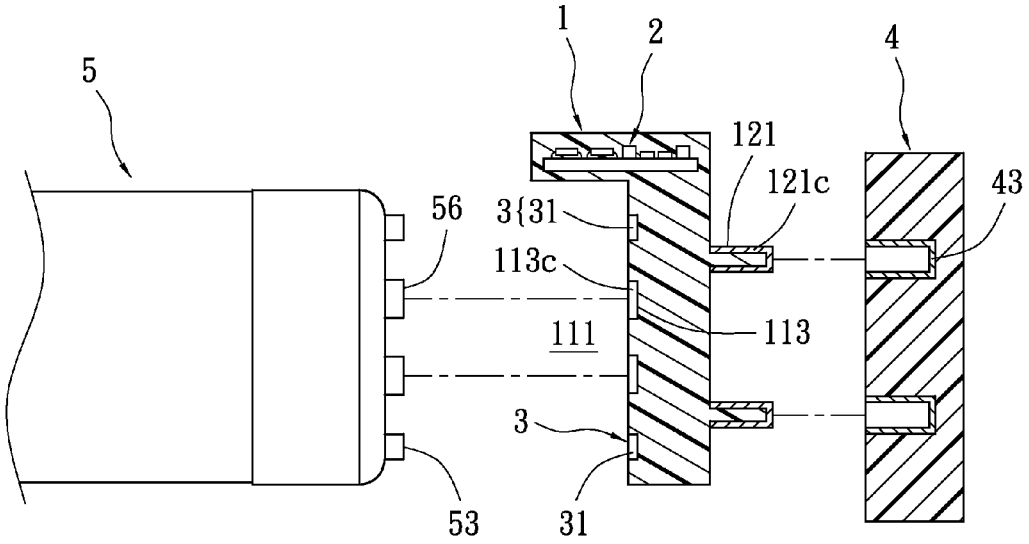
FIG. 8 shows a cross sectional schematic diagram of a seventh embodiment of the present disclosure.
Figure 9:
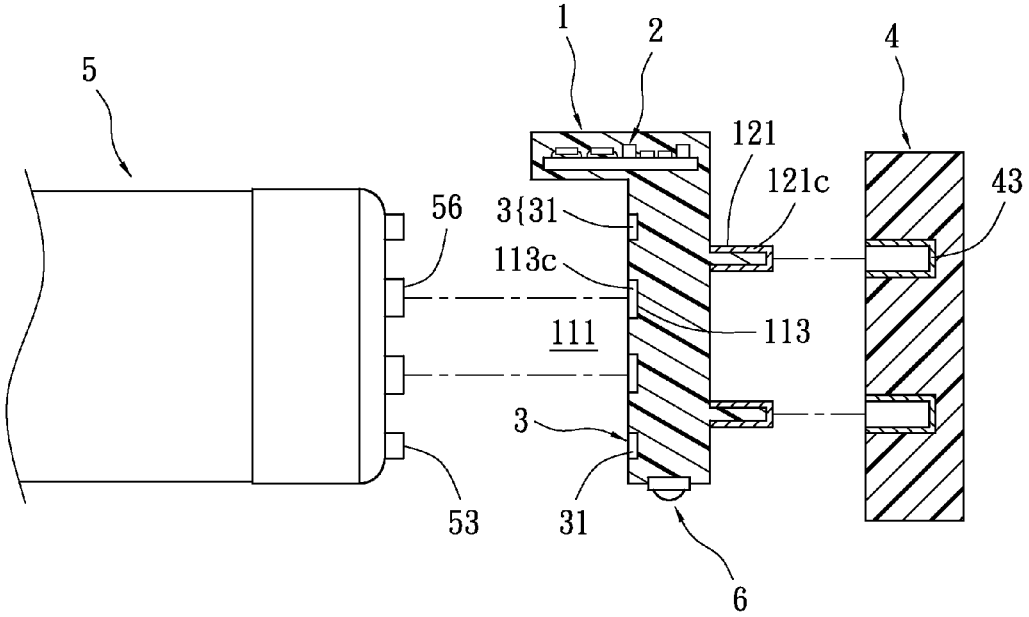
FIG. 9 shows a cross sectional schematic diagram of a eighth embodiment of the present disclosure.

FIG. 8 and FIG. 9 show respectively a seventh and an eighth embodiment of the present disclosure. The present embodiments are suitable for light sources such as light tubes. The light source can be light emitting diode, etc. the magnetic light source adaptor likewise includes a main body 1, a control module 2 and a magnetic unit 3. The main body 1 of the present embodiment is designed to adapt to the tube type light source 5 and the lamp socket 4. Namely, an accommodating space 111 is configured inside the main body 1 to match the tube type light source 5. A first conducting set 113 is disposed inside the main body 1. The first conducting set 113 of the present embodiments includes two conducting seats 113*c*, for two connecting feet 56 (also serving as two contacting points) of the light source 5 to be connected to. A second conducting set 121 is disposed on the outer part of the main body 1. The second conducting set 121 of the present embodiments include two conducting terminals 121*c*. The magnetic light source adaptor can use the main body 1 to be plugged into a conventional lamp socket 4, such that the magnetic light source adaptor is installed on the lamp socket 4 in a removable manner, and that the two conducting terminals 121*c* are electrically connected to the two corresponding lamp socket contact points 43 of the lamp socket 4. Thereafter, the light source 5 can be connected to the main body 1, such that the light source 5 is installed on the magnetic light source adaptor in a removable manner, and that the two connecting feet 56 of the light source 5 can be in contact with the two corresponding conducting seats 113*c* to achieve electrical connection, thus power supplied by the lamp socket 4 can be transmitted to the light source 5 via the magnetic light source adaptor. The magnetic unit 3 is disposed on the main body 1, for magnetically attracting and fixing the light source 5. The magnetic unit 3 can be a first magnet 31. A second magnet 53 corresponding to the first magnet 31 can be disposed on the light source 5, such that the first magnet 31 and the second magnet 53 can be mutually attracted and fixed to each other. Additionally, the first conducting set 113 and the magnetic unit 3 can be integrated into one body (not shown in the figure). Namely, the first conducting set 113 can be directly made of magnet. The two connecting feet 56 of the light source 5 can also be made of magnet, such that the first conducting set 113 and the two connecting feet 56 can be electrically connected and mutually attracted and fixed.

Ninth Embodiment

Figure 10:
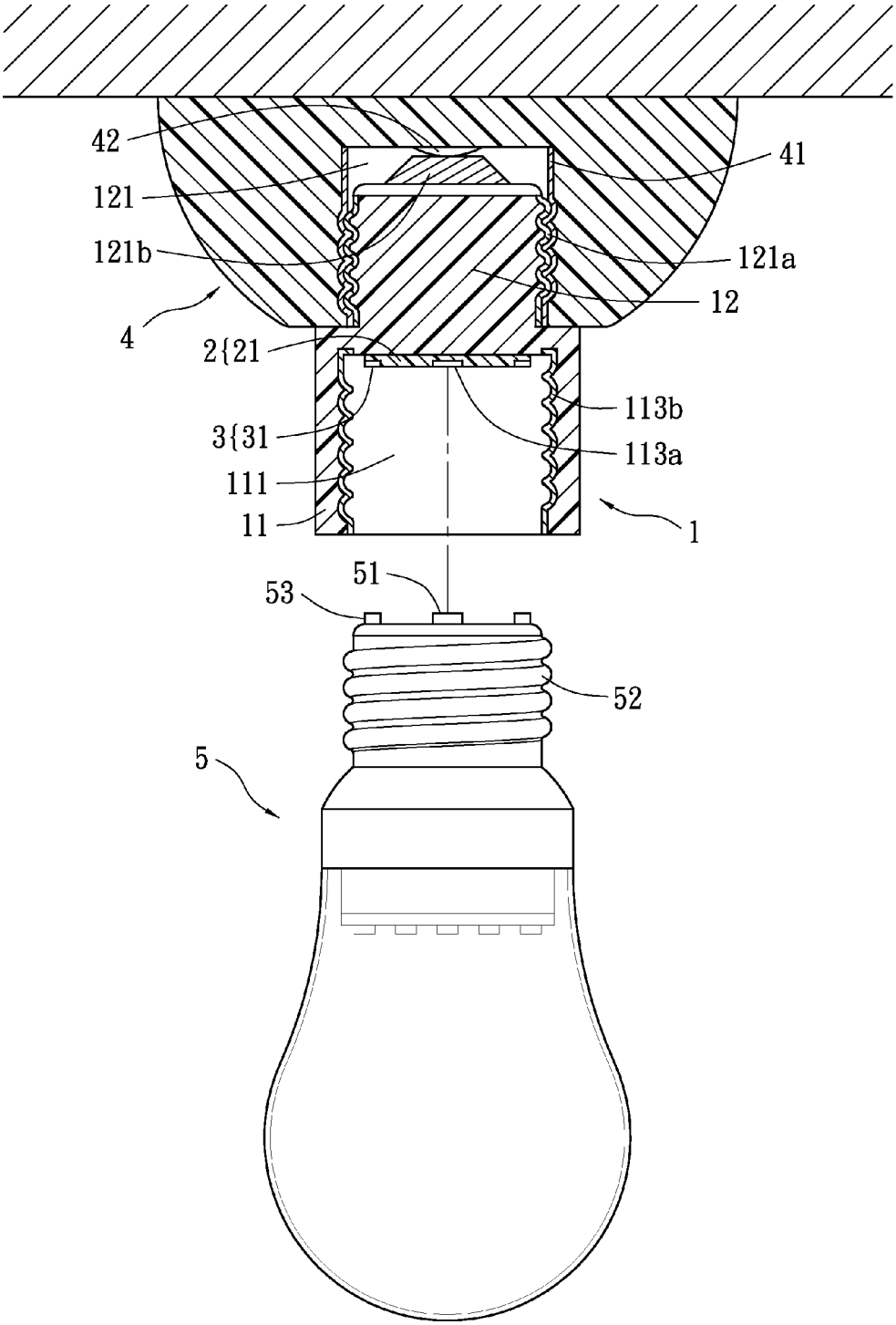
FIG. 10 shows a cross sectional schematic diagram of a ninth embodiment of the present disclosure.

FIG. 10 is a ninth embodiment of the present disclosure. The first conducting set 113 of the present embodiment is of a screw type. The first conducting set 113 includes a first conducting member 113*a* and a second conducting member 113*b*. The first conducting member 113*a* and the second conducting member 113*b* are respectively fixed on the top part and the lateral wall of the accommodating space 111. The second conducting member 113*b* is a threaded sleeve, such that the light source 5 can be screwed into the first conducting set 113. The first contact point 51 and the second contact point 52 of the light source 5 are likewise of screw type. The first contact point 51 and the second contact point 52 can be respectively in contact with the first conducting member 113*a* and the second conducting member 113*b* of the main body 1 to achieve electrical connection. The magnetic unit (the first magnet 31) 3 can be disposed on the main body 1, and a second magnet (magnet) 53 corresponding to the first magnet 31 can also be disposed on the light source 5, such that the first magnet 31 and the second magnet 53 are mutually attracted and fixed to each other.

Tenth Embodiment

Figure 11:
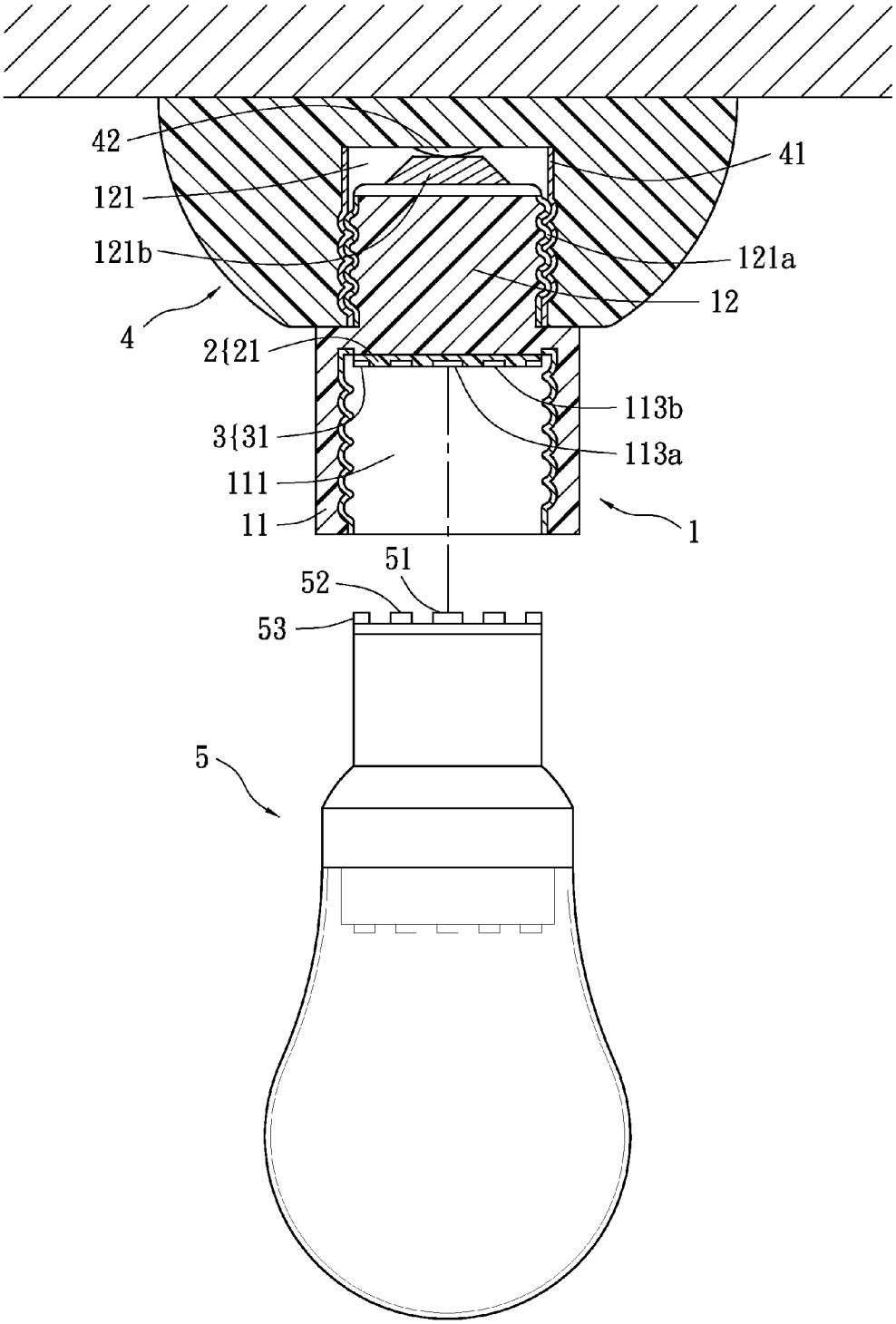
FIG. 11 shows a cross sectional schematic diagram of a tenth embodiment of the present disclosure.

FIG. 11 shows a tenth embodiment of the present disclosure. The first conducting set 113 of the present embodiment is of plug type. The first conducting member 113*a* is positioned at the center of the top part of the accommodating space 111. The second conducting member 113*b* can be positioned around the first conducting member 113*a*. The first contact point 51 and the second contact point 52 of the light source 5 are also of plug type. The first contact point 51 and the second contact point 52 can be respectively in contact with the first conducting member 113*a* and the second conducting member 113*b* of the main body 1 to achieve electrical connection.

Eleventh Embodiment

Figure 12:
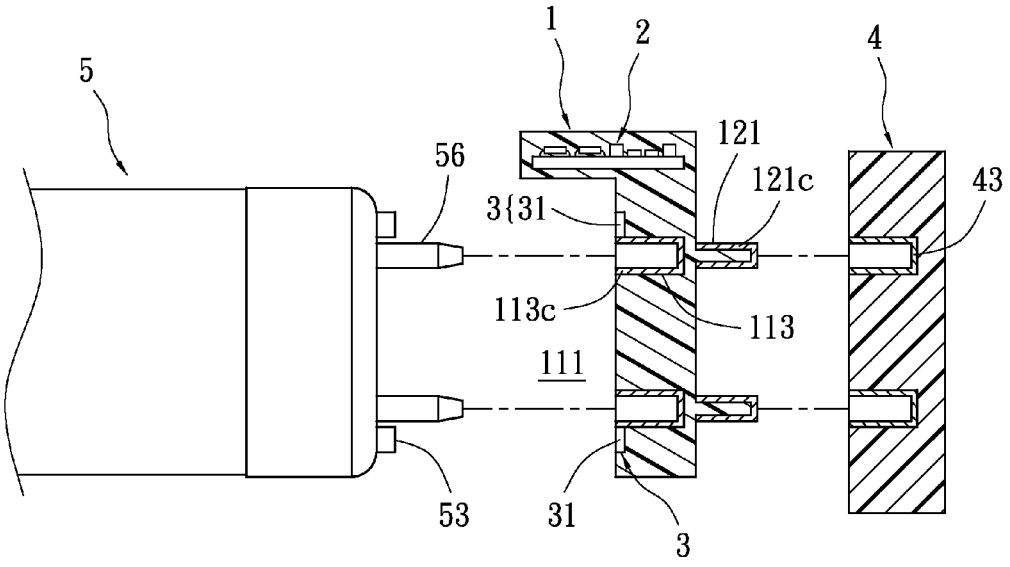
FIG. 12 shows a cross sectional schematic diagram of a eleventh embodiment of the present disclosure.

FIG. 12 shows the eleventh embodiment of the present disclosure. The present embodiment is suitable for tube type light source. The magnetic light source adaptor likewise includes a main body 1, a control module 2 and a magnetic unit 3. The difference between this embodiment and the above mentioned embodiment lies in that the two connecting feet 56 of the light source 5 of the present embodiment can be plugged into the two conducting seats 113*c* to achieve electrical connection.

Twelfth, Thirteenth, and Fourteenth Embodiments

Figure 13:
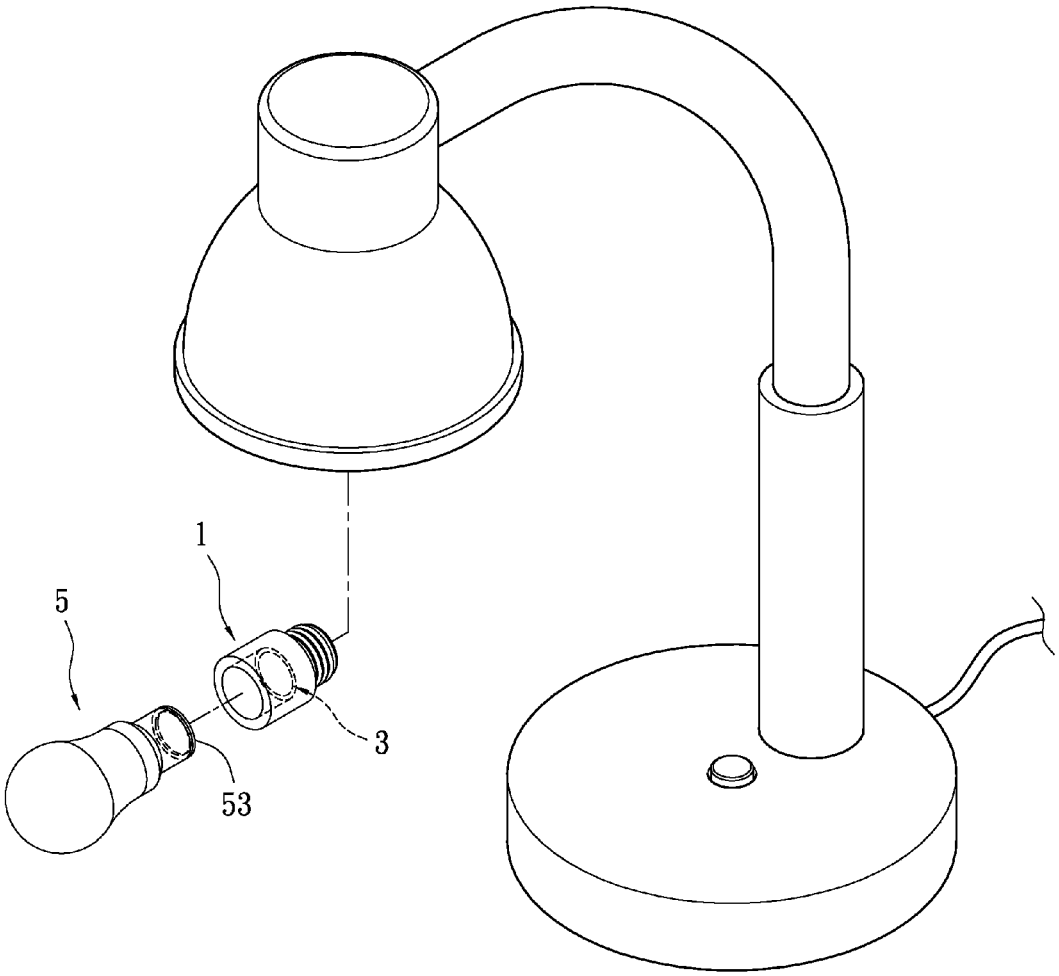
FIG. 13 shows a perspective schematic diagram of a twelfth embodiment of the present disclosure.
Figure 14:
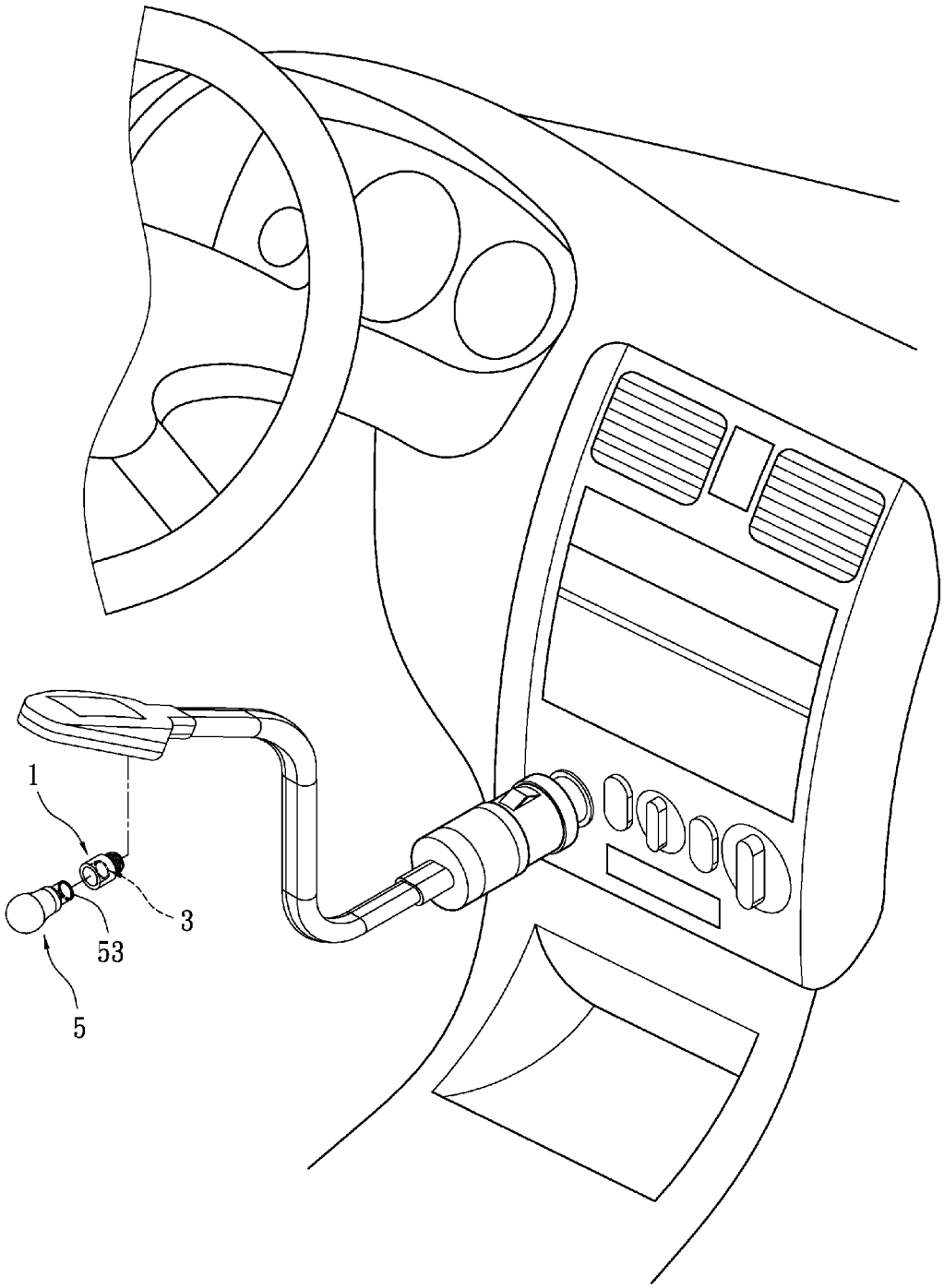
FIG. 14 shows a perspective schematic diagram of a thirteenth embodiment of the present disclosure.
Figure 15:
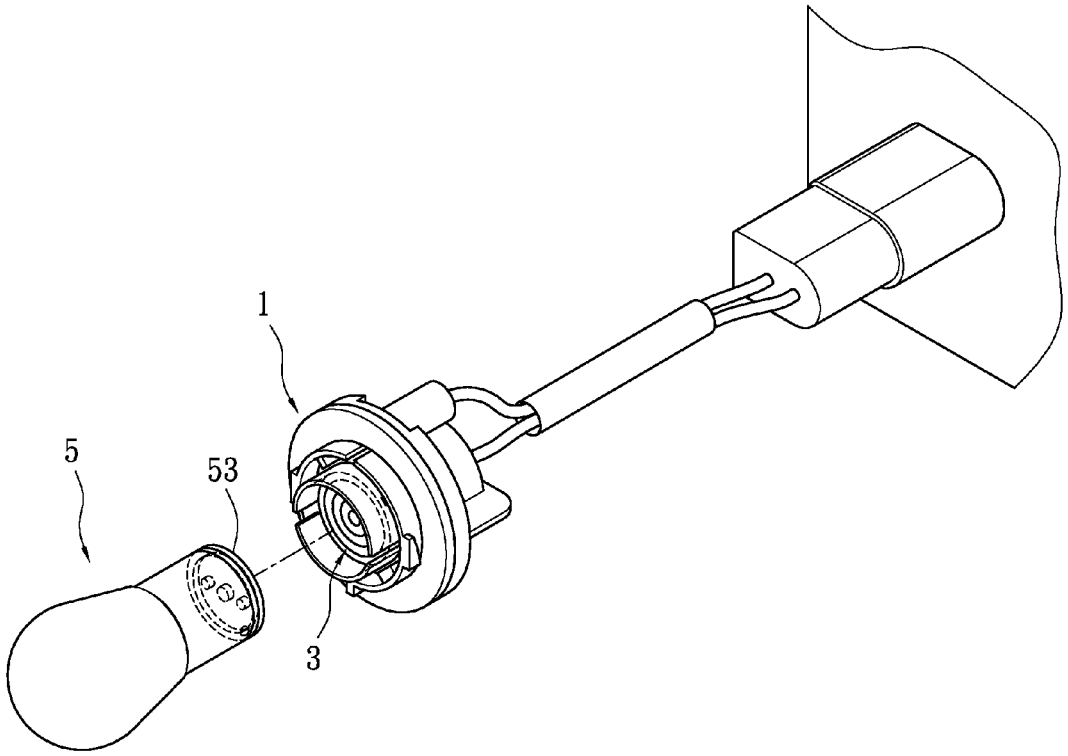
FIG. 15 shows a perspective schematic diagram of a fourteenth embodiment of the present disclosure.

FIG. 13, FIG. 14, and FIG. 15 show respectively the twelfth, thirteenth and fourteenth embodiments of the present disclosure, which respectively disclose that the magnetic light source adaptor of the present disclosure can be applied on desk lamps, reading lights for inside cars, and headlights for cars. Additionally, the magnetic light source adaptor of the present disclosure can also be applied on emergency lights, car brake lights, sensing devices, etc.

Fifteenth Embodiment

Figure 16:
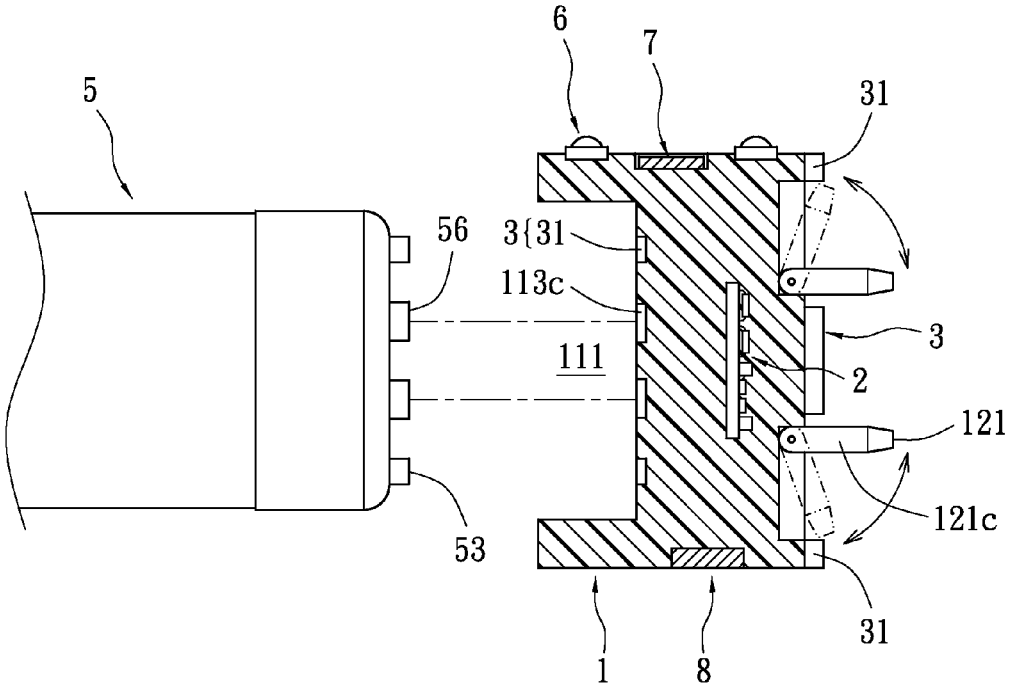
FIG. 16 shows a cross sectional schematic diagram of a fifteenth embodiment of the present disclosure.

FIG. 16 shows the fifteenth embodiment of the present disclosure. The shape of the main body 1 of the present embodiment is modified. A sensor 8 can be disposed on the main body 1. The sensor 8 is electrically connected to the control module 2, for sensing light or human bodies, thereby controlling the brightness and turning on and off of the light source 5. A second conducting set 121 is disposed on the outer part of the main body 1. The two conducting terminals 121*c* of the second conducting set 121 are disposed on the main body 1 in a foldable manner. When not in use, the conducting terminals 121*c* can be folded against the main body 1. The magnetic unit 3 is disposed on the outer part of the main body 1, and can be used for attracting and fixing the magnetic light source adaptor to other objects or for serially connecting to other conversion devices. Wireless transmission device (not shown in the figure) can also be disposed on the main body 1.

Sixteenth Embodiment

Figure 17:
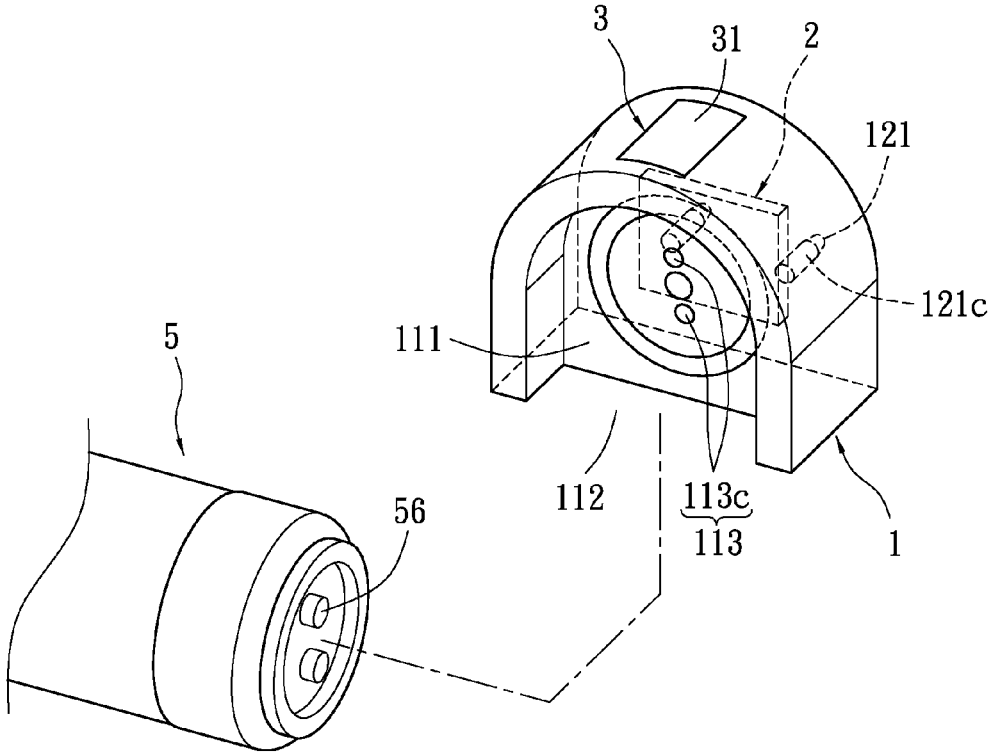
FIG. 17 shows a perspective schematic diagram of a sixteenth embodiment of the present disclosure.

FIG. 17 shows the sixteenth embodiment of the present disclosure. The shape of the main body 1 of the present embodiment is modified. An opening 112 of the main body 1 is disposed on one side and the bottom part of the accommodating space 111, such that a tube type light source 5 can be inserted into the accommodating space 111 from one side or the bottom part. The magnetic unit 3 is disposed on the outer part of the main body 1, and can be used for attracting and fixing the magnetic light source adaptor to other objects.

Seventeenth Embodiment

Figure 18:
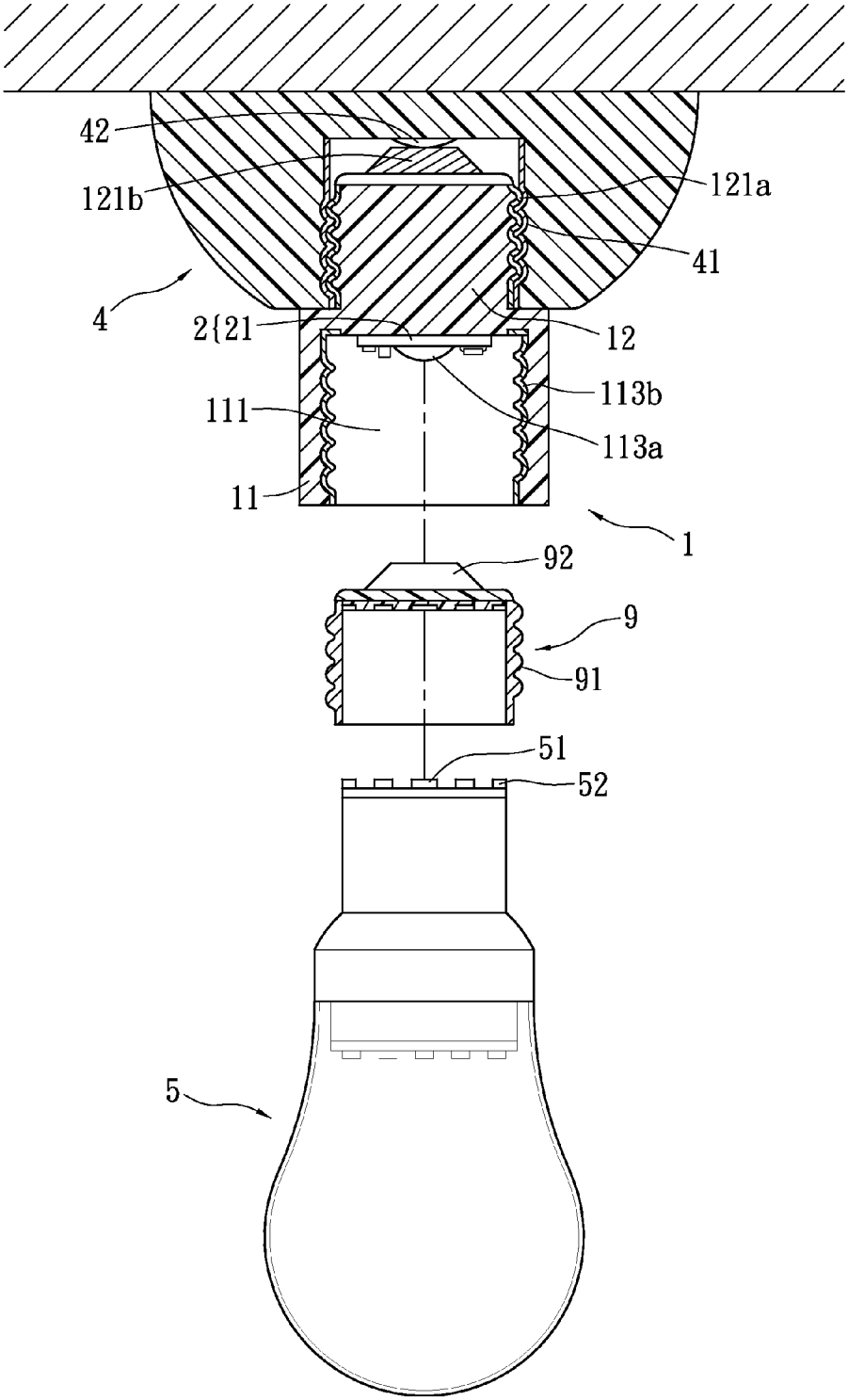
FIG. 18 shows a cross sectional schematic diagram of a seventeenth embodiment of the present disclosure.

FIG. 18 shows the seventeenth embodiment of the present disclosure. The light source 5 of the present disclosure can be assembled with a threaded cover 9, for screwing into the main body 1 or the lamp socket 4. When the threaded cover 9 is removed, the light source 5 can be assembled to the main body 1 or the lamp socket 4 by plugging. The threaded cover 9 has a threaded sleeve 91 and a contact plate 92. The threaded sleeve 91 is a threaded structure. The threaded sleeve 91 and the contact plate 92 partially extend to the neck part inside the threaded cover 9 (as the first conducting member 113*a* and the second conducting member 113*b* of FIG. 2 do), and can be electrically connected to the first contact point 51 and the second contact point 52. The threaded sleeve 91 and the contact plate 92 can also be in contact with the main body 1 or the lamp socket 4 to achieve electrical connection.

Eighteenth Embodiment

Figure 19:
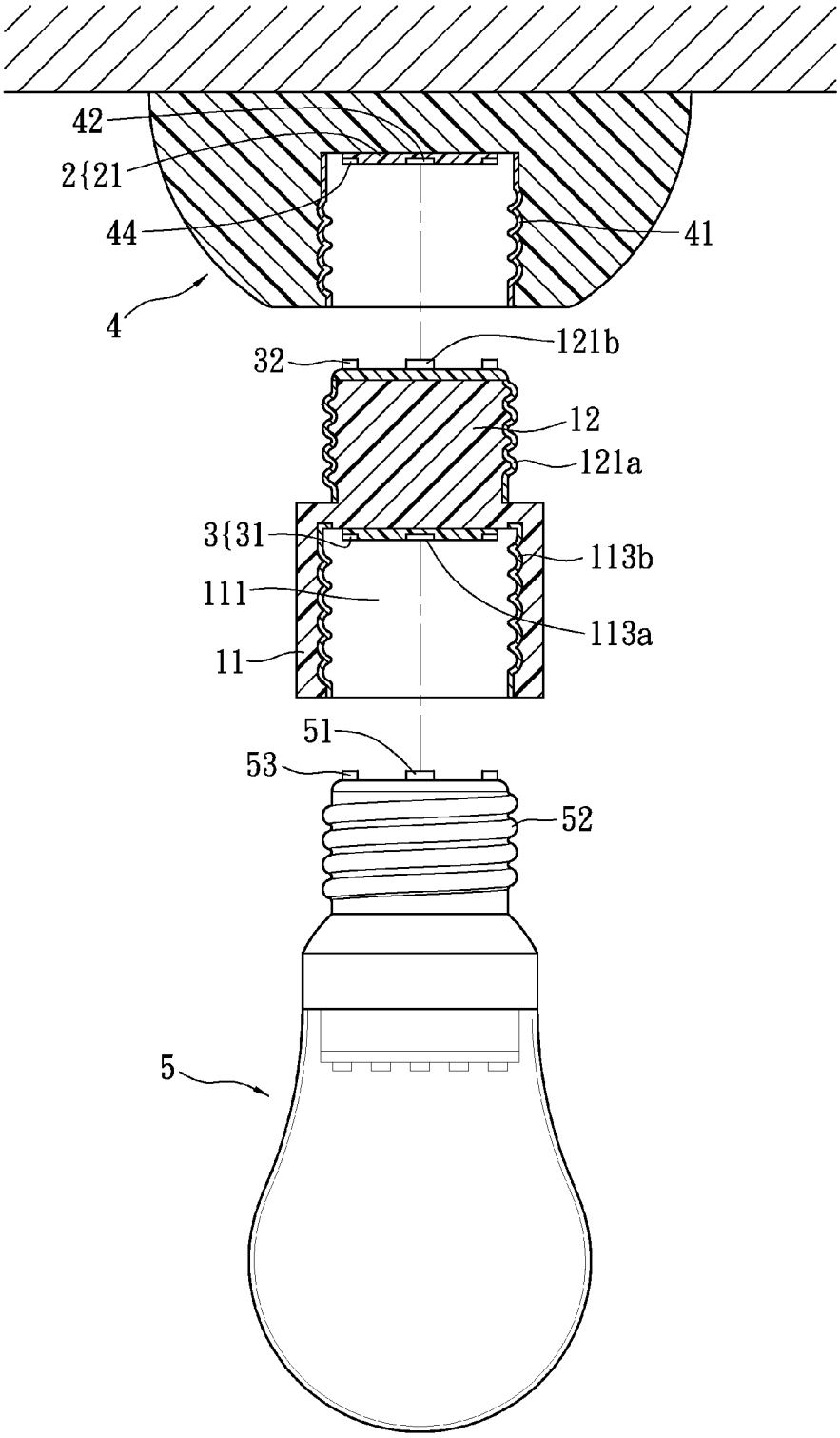
FIG. 19 shows a cross sectional schematic diagram of an eighteenth embodiment of the present disclosure.

FIG. 19 shows the eighteenth embodiment of the present disclosure. A third magnet 32 is further disposed on the male portion 12 of the magnetic light source adaptor. A corresponding fourth magnet 44 is disposed on the lamp socket 4, such that the third magnet 32 and the fourth magnet 44 can mutually be attracted and fixed to each other.

The magnetic light source adaptor of the present disclosure is designed as an assembly, and has a magnetic unit 3 for fixing by magnetic attraction. When the control module 2 or the light source 5 of the magnetic light source adaptor is damaged, each can be independently replaced to avoid waste, meeting the modern environmental standards. The magnetic light source adaptor can be installed with the lamp socket 4 and the light source 5 in a removable manner, exposing the outer portions, facilitating the installation and disassembly between the same.

Moreover, a signaling device 6 can be disposed on the magnetic light source adaptor of the present disclosure. When the control module 2, the light source 5 or the power supply is damaged, the signaling device 6 can emit sound or light to indicate the damage, to facilitate the repair and replacement of the damaged components.

Additionally, a control module 2 is disposed on the magnetic light source adaptor of the present disclosure, therefore the power supply can be converted into power usable by LED bulbs, and the changes of the LED bulbs can be controlled, such that a conventional lamp socket can be used for LED bulbs.

Nineteenth Embodiment

Figure 20:
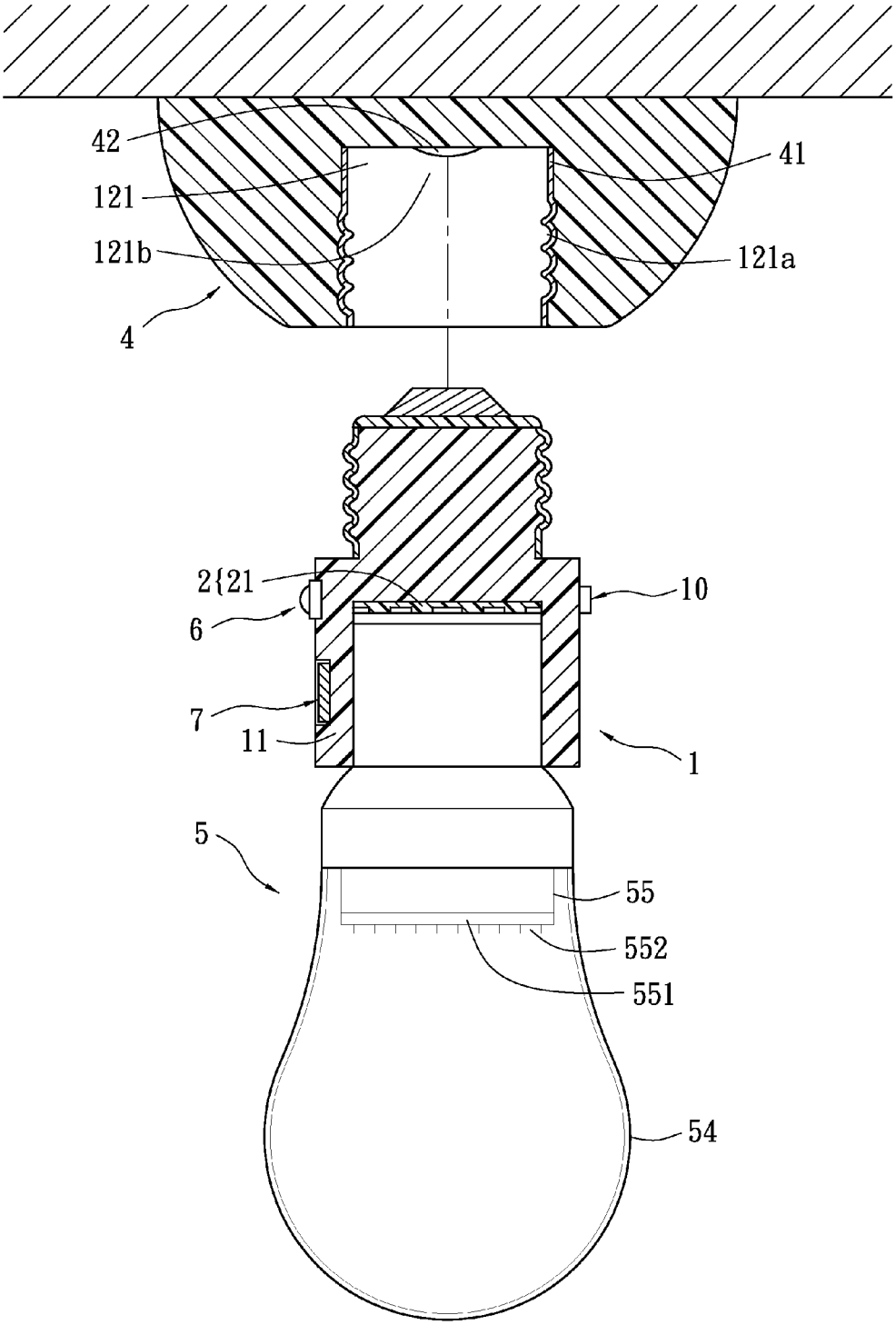
FIG. 20 shows a cross sectional schematic diagram of a nineteenth embodiment of the present disclosure.
Figure 21:
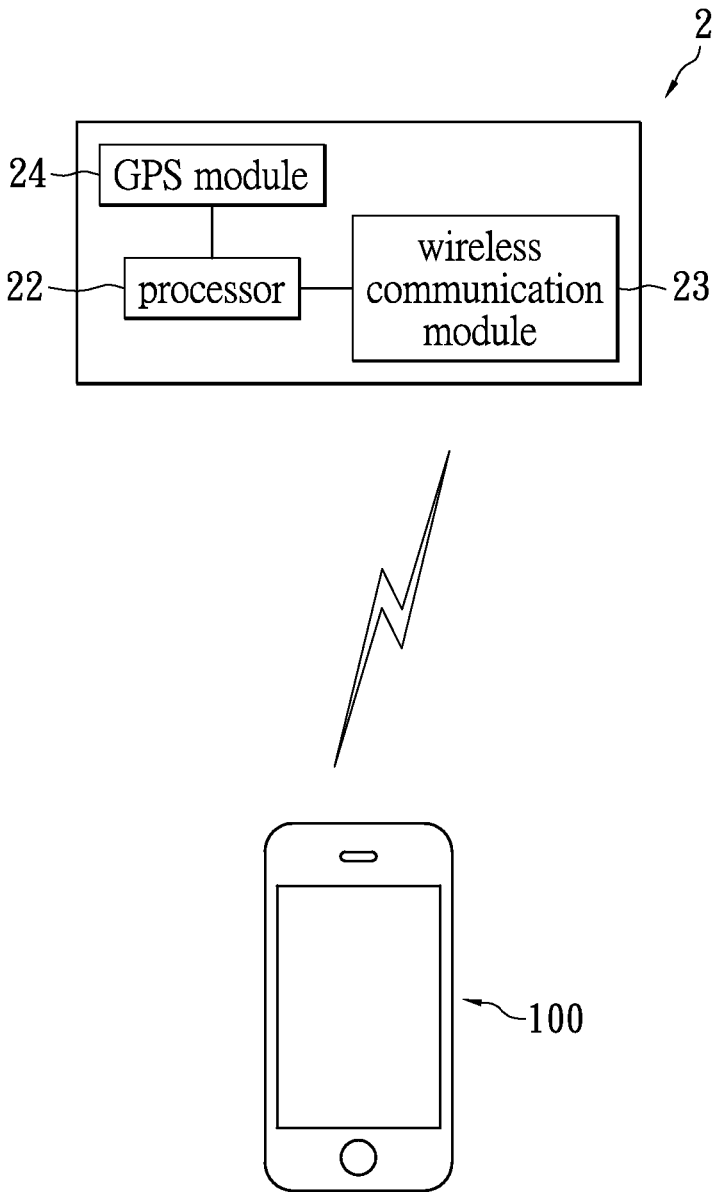
FIG. 21 shows a functional block diagram of a nineteenth embodiment of the present disclosure.

FIGS. 20 and 21 show the nineteenth embodiment of the present disclosure. The light source 5 is secured to the female portion 11 of the main body 1 in a removable manner and both of them are dismantled from the lamp socket 4, the light source 5 along with the female portion 11 of the main body 1 can act as a torch/flashlight, and can further convert from a flashlight to an emergency flashlight.

Moreover, the control module 2 with wireless communication capability is configured for wirelessly receiving a control signal transmitted from a handheld device 100 (as shown in FIG. 21), so that the light source 5 along with the main body 1 can be controlled by the handheld device 100.

Specifically, the control module 2 has a processor 22 and a wireless communication module 23. The wireless communication module 23 is electrically connected to the processor 22. The wireless communication module 23 is used to receive the control signal transmitted from the handheld device 100. The processor 22 is used to process the control signal for controlling the light source 5 to emit a white light, a yellow light, or a red flashing light according to the control signal transmitted from the handheld device 100. Thus, the handheld device 100 can be wirelessly connected to the control module 2, for remotely switching the function mode between emergency lighting and flashlight More specifically, the control module 2 has a global positioning system (GPS) module 24 electrically connected to the processor 22 for determining the geographic location of the main body 1 of the light source adaptor when the function mode of emergency light is activated. Thus, the control module 2 can broadcast the geographic location to allow emergency responders to follow and find the light source adaptor.

The descriptions illustrated supra set forth simply the preferred embodiments of the present invention; however, the characteristics of the present invention are by no means restricted thereto. All changes, alternations, or modifications conveniently considered by those skilled in the art are deemed to be encompassed within the scope of the present invention delineated by the following claims.

What is claimed is:

1. A magnetic light source adaptor for connecting a light source to a lamp socket, comprising:

a main body, having a female portion and a male portion, wherein an accommodating space is formed in the female portion, a first conducting set is disposed within the female portion, and a second conducting set is disposed on the male portion;

a control module disposed on the main body, wherein the control module is electrically connected to the first conducting set and the second conducting set, wherein the control module with wireless communication capability is configured for wirelessly receiving a control signal transmitted from a handheld device;

a magnetic unit disposed on the main body; and a battery disposed on the main body, wherein the battery is electrically connected to the control module;

wherein when the light source is secured to the main body in a removable manner and both of them are dismantled from the lamp socket, the light source along with the main body act as a torch.

2. The magnetic light source adaptor for connecting a light source to a lamp socket according to claim 1, wherein the magnetic unit is fixed on the main body.

3. The magnetic light source adaptor for connecting a light source to a lamp socket according to claim 1, wherein the control module has a circuit board, and the magnetic unit is fixed on the circuit board.

4. The magnetic light source adaptor for connecting a light source to a lamp socket according to claim 1, wherein the magnetic unit is a first magnet.

5. The magnetic light source adaptor for connecting a light source to a lamp socket according to claim 1, wherein at least one signaling device is disposed on the main body for signaling damage, the signaling device emits light or sound, and the signaling device is electrically connected to the control module.

6. The magnetic light source adaptor for connecting a light source to a lamp socket according to claim 5, wherein the signaling device is a light-emitting diode, the amount of the signaling device is multiple, and the signaling devices are dotted or ringed around the outer edge of the female portion.

7. The magnetic light source adaptor for connecting a light source to a lamp socket according to claim 1, wherein the light source has a first contact point and a second contact point, the first conducting set comprises a first conducting member and a second conducting member, the first contact point and the second contact point are respectively electrically connected to the first conducting member and the second conducting member, a second magnet is disposed on the light source, and the magnetic unit and the second magnet are mutually attracted and fixed to each other.

8. The magnetic light source adaptor for connecting a light source to a lamp socket according to claim 1, wherein the light source has a first contact point and a second contact point, the first contact point and the second contact point are magnets, the first conducting set includes a first conducting member and a second conducting member, the first conducting member and the second conducting member are magnets, with the first conducting member and the second conducting member forming the magnetic unit, the first contact point and the second contact point are electrically connected, attracted and fixed respectively to the first conducting member and the second conducting member.

9. The magnetic light source adaptor for connecting a light source to a lamp socket according to claim 1, wherein a sensor, wireless transmission device or switch are disposed on the main body.

10. The magnetic light source adaptor for connecting a light source to a lamp socket according to claim 1, wherein when the main body is assembled to the lamp socket, the second conducting set is electrically connected to the lamp socket.

11. A magnetic light source adaptor for connecting a light source to a lamp socket, comprising:

a main body, wherein an accommodating space is formed within, and a first conducting set and a second conducting set are disposed on the main body;

a control module, disposed on the main body, wherein the control module is electrically connected to the first conducting set and the second conducting set, and wherein the control module with wireless communication capability is configured for wirelessly receiving a control signal transmitted from a handheld device;

a magnetic unit, disposed on the main body; and a battery disposed on the main body, wherein the battery is electrically connected to the control module;

wherein when the light source is secured to the main body in a removable manner and both of them are dismantled from the lamp socket, the light source along with the main body act as a torch.

12. The magnetic light source adaptor for connecting a light source to a lamp socket according to claim 11, wherein the control module has a circuit board, and the magnetic unit is fixed to the circuit board.

13. The magnetic light source adaptor for connecting a light source to a lamp socket according to claim 11, wherein the magnetic unit is a first magnet.

14. The magnetic light source adaptor for connecting a light source to a lamp socket according to claim 11, wherein at least one signaling device is disposed on the main body for signaling damage, the signaling device emits light or sound, and the signaling device is electrically connected to the control module.

15. The magnetic light source adaptor for connecting a light source to a lamp socket according to claim 11, wherein the light source has a first contact point and a second contact point, the first conducting set comprises a first conducting member and a second conducting member, the first contact point and the second contact point are respectively electrically connected to the first conducting member and the second conducting member, a second magnet is disposed on the light source, and the magnetic unit is attracted and fixed to the second magnet.

16. The magnetic light source adaptor for connecting a light source to a lamp socket according to claim 11, wherein the light source has a first contact point and a second contact point, the first contact point and the second contact point are magnets, the first conducting set comprises a first conducting member and a second conducting member, the first conducting member and the second conducting member are magnets, with the first conducting member and the second conducting member forming the magnetic unit, the first contact point and the second contact point are electrically connected, attracted and fixed respectively to the first conducting member and the second conducting member.

17. The magnetic light source adaptor for connecting a light source to a lamp socket according to claim 11, wherein a sensor, a wireless transmission device, or a switch are disposed on the main body.

18. The magnetic light source adaptor for connecting a light source to a lamp socket according to claim 11, wherein when the main body is assembled to the lamp socket, the second conducting set is electrically connected to the lamp socket.

19. The magnetic light source adaptor for connecting a light source to a lamp socket according to claim 11, wherein the light source has a first contact point and a second contact point, wherein a magnet is disposed on the light source.

20. The magnetic light source adaptor for connecting a light source to a lamp socket according to claim 19, wherein the light source is of a light bulb type or of a light tube type.

21. The magnetic light source adaptor for connecting a light source to a lamp socket according to claim 19, wherein the light source is a light-emitting diode.

22. The magnetic light source adaptor for connecting a light source to a lamp socket according to claim 19, wherein the light source is assembled with a threaded cover, a threaded sleeve and a contact plate are disposed on the threaded cover, and the first contact point and the second contact point are electrically connected to the threaded sleeve and contact plate.

23. A magnetic light source adaptor for connecting a light source to a lamp socket, comprising:

a main body, wherein an accommodating space is formed within, a first conducting set and a second conducting set are disposed on the main body, and a battery is disposed on the main body in a removable manner;

a control module, disposed on the main body, wherein the control module is electrically connected to the first conducting set and the second conducting set, and the battery is electrically connected to the control module; and a magnetic unit, disposed on the main body;

wherein when the light source is secured to the main body in a removable manner and both of them are dismantled from the lamp socket, the light source along with the main body act as a torch.

24. The magnetic light source adaptor for connecting a light source to a lamp socket according to claim 23, wherein the control module with wireless communication capability is configured for wirelessly receiving a control signal transmitted from a handheld device.

25. The magnetic light source adaptor for connecting a light source to a lamp socket according to claim 24, wherein the control module has a processor and a wireless communication module electrically connected to the processor, the wireless communication module is used to receive the control signal, and the processor is used to process the control signal for controlling the light source to emit a white light, a yellow light, or a red flashing light according to the control signal transmitted from the handheld device.

26. The magnetic light source adaptor for connecting a light source to a lamp socket according to claim 25, wherein the control module has a global positioning system module electrically connected to the processor for determining a geographic location of the main body.

* * * * *